US006729596B2

(12) United States Patent
Fumado Gilabert

(10) Patent No.: US 6,729,596 B2
(45) Date of Patent: May 4, 2004

(54) STRUCTURE FOR SUPPORT AND POSITIONAL REGULATION OF AUTOMATED LEVELLING SYSTEMS

(75) Inventor: Juan Luis Fumado Gilabert, Barcelona (ES)

(73) Assignee: Technologia, Maquinaria Y Componentes, S.L., Barcelona (ES)

( * ) Notice: Subject to any disclaimer, the term of this patent is extended or adjusted under 35 U.S.C. 154(b) by 0 days.

(21) Appl. No.: 10/336,968

(22) Filed: Jan. 6, 2003

(65) Prior Publication Data

US 2004/0056170 A1 Mar. 25, 2004

(30) Foreign Application Priority Data

Sep. 25, 2002 (EP) ..... 02380201

(51) Int. Cl.[7] ..... F16M 13/00
(52) U.S. Cl. ..... 248/550; 404/84.05
(58) Field of Search ..... 404/84.05, 84.1, 404/84.5; 248/550, 298.1, 287.1; 172/4

(56) References Cited

U.S. PATENT DOCUMENTS 5,362,177 A * 11/1994 Bowhall et al. ..... 404/84.1
5,599,134 A * 2/1997 Macku et al. ..... 404/84.1
5,702,201 A * 12/1997 Macku et al. ..... 404/75
5,975,473 A * 11/1999 Haas et al. ..... 248/282.1
6,352,386 B2 * 3/2002 Heims ..... 404/84.5

* cited by examiner

*Primary Examiner*—Ramon O. Ramirez
(74) *Attorney, Agent, or Firm*—Katten Muchin Zavis Rosenman

(57) ABSTRACT

A structure to be coupled to a machine for treating surfaces, comprising a centre web (1) joined to a machine (2) in which are movably and tightly fined with the aid of bearings a pair of telescoping superposed arms (6–6') whose segments can be locked at any relative position, the segments ending in clips (19) for attaching the vertical tubes (24) that in turn incorporate on their lower corresponding sensors, with another clip (25) provided in the centre web (1) for attaching another sensor at this intermediate position. The sensors are thus capable of adopting any relative separation with adjustment operations that are extremely quick and simple, by simply releasing and again locking, while the height of said sensors can also be adjusted by loosening and tightening the clips (19).

6 Claims, 3 Drawing Sheets

STRUCTURE FOR SUPPORT AND POSITIONAL REGULATION OF AUTOMATED LEVELLING SYSTEMS

OBJECT OF THE INVENTION

The present invention relates to a structure meant to be coupled to machinery for treating surfaces, such as an asphalt millers, levellers, pavers or asphalt heaters, as means for support and positional regulation of the automated levelling systems fitted in these machines to detect the unevenness of the ground so that the asphalt is properly distributed and the irregularities are smoothed out.

The object of the invention is to provide, in addition to an optimal attachment of the height sensors, a great ease of operation when changing the length of action of said sensors, adapting said position to the specific requirements of each case.

BACKGROUND OF THE INVENTION

As it is known, machinery such as asphalt millers, levellers, pavers or asphalt heaters, and in general machines for treating surfaces, are fitted with a number of sensors, generally three, to distribute the asphalt smoothly in view of the unevenness of the ground, with these sensors being separated from each other by between 4 and 16 metres. The sensors convey the information obtained on the ground to a control unit that, in view of the irregularities, will control the asphalt flow supplied by the machine at each time.

In order to support said sensors, and particularly in order to adjust their spacing, rigid bolted members 2 to 3 metres in length are currently used, which preclude an instantaneous adjustment of the system and force to stop the machine to perform said operation, with a considerable assembly time.

Also known is the use of jointed strips of similar dimensions to the aforementioned ones that fold and unfold depending on the distance to be controlled.

This system is cumbersome and unpractical, particularly for use in narrow streets or areas where it is difficult to obtain the space required to perform the folding and unfolding manoeuvre.

DESCRIPTION OF THE INVENTION

The support structure disclosed by the invention solves the aforementioned problems in a fully satisfactory manner, by means of a telescoping design of the two arms that support the sensors, emerging from a centre core or web with respect to which said arms can slide by means of bearings that ensure a smooth motion of the arms and by the existence of fast attachment means for the various sectors of the telescoping arms and for attaching the vertical bars bearing the sensors and said sensors to the aforementioned arms.

More specifically, the centre web is embodied as a cage, preferably made of steel or some other strong material, which given the absence of play determined by the aforementioned bearings allows a transverse motion of the telescoping arms, and which has a main support for its attachment to the asphalt beater that separates and lifts the web itself, as well as being provided with a support for the system control unit and optionally with a mast allowing to brace the telescoping arms when their extension or effective length requires so.

The telescoping arms, embodied as tubes of aluminium or another lightweight and strong material, are connected to each other by caps made of Teflon (polytetrafluoroethylene) or another low-friction material, as well as having bearings that ensure ideal sliding conditions without clearance, as well as having fast-action locking means in each segment that act on the next adjacent segment in order to lock the arm at any effective length that is required of it.

The end segment of each arm is provided at its free end with a fast-closure clip for attaching the vertical tube that supports the corresponding sensor, with another similar clip provided in the centre web for the sensor occupying said position. However, it is obvious that clips can also be provided at the free end of each segment of the telescoping arms when a greater number of sensors is used.

It turn, each sensor will have an element for attachment to the corresponding tube, and the height of the sensor can be adjusted as a function of the position of the vertical tube with respect to the upper clip to which it is attached.

In this manner, a support structure is obtained in which the various sensors can adopt any relative position deemed suitable, which position can be changed in an extremely quick and simple operation, with full operational reliability and with full stability of said sensors.

DESCRIPTION OF THE DRAWINGS

As a complement of the description being made and in order to aid a better understanding of the characteristics of the invention, according to an example of a preferred embodiment, a set of drawings is provided as an integral part of the present description where for purposes of illustration only and in a non-limiting sense the following is shown.

PREFERRED EMBODIMENT OF THE INVENTION

Figure 1:
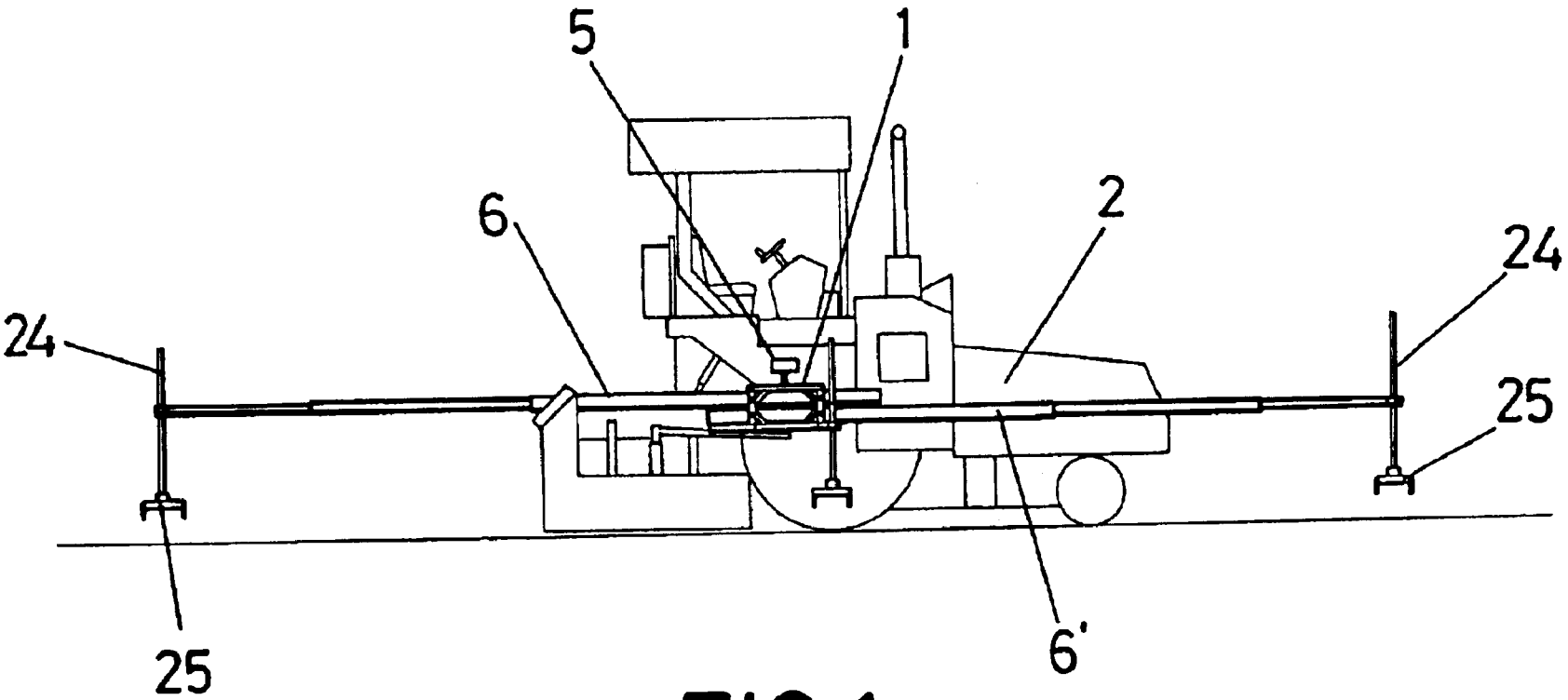
FIG. 1 shows a perspective view of a structure for support and positional regulation of automated levelling systems according to the object of the present invention, suitably coupled to an asphalt heater in accordance with a preferred embodiment where each arm of the structure has three telescoping segments and in which three sensors are used.

In view of the above-described figures, it can be appreciated that the structure of the invention consists of a centre web (1) that forms a sort of rectangular prismatic cage, specifically by means of sections that correspond to the edges of said imaginary prism, with the face of the prism fitted on the machine (2) being attached to a strong tube (3) disposed with a downwards and outwards inclination, to define the bridge that joins the centre web (1) to said machine (2), as well as having a support (4) for the control unit (5) and optionally a mast, not shown in the drawings, to brace the arms (6–6') when required.

Figure 2:
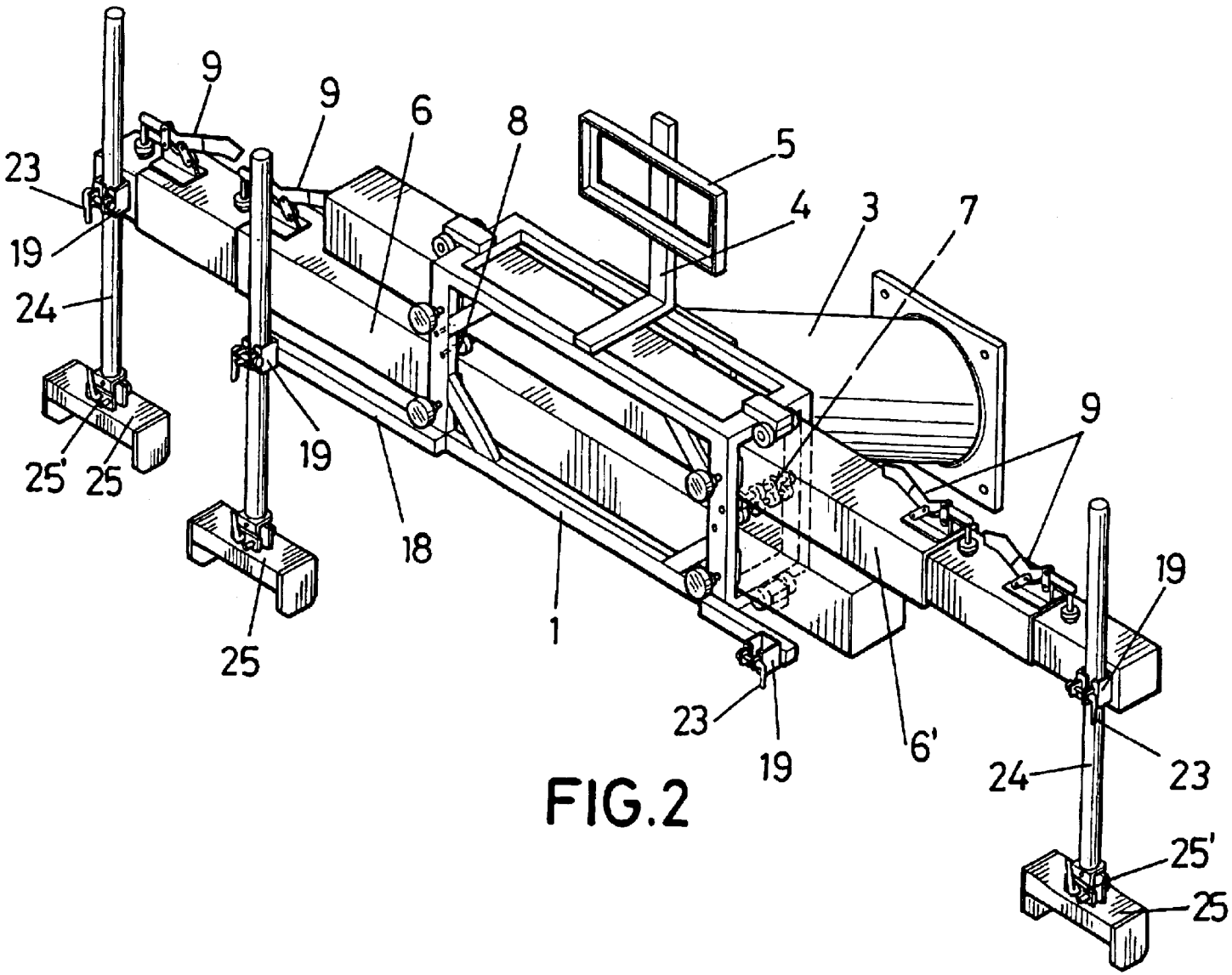
FIG. 2 shows a similar perspective view to FIG. 1, wherein the structure is uncoupled from the machine and its arms are fully retracted.

The arms (6–6') are set longitudinally inside the centre web (1), superposed as seen particularly in FIG. 2, and aided by bearings (7) mounted on transverse shafts (8) that are meant to ensure a perfect fit of the arms (6–6') in the web (1) as well as optimal sliding conditions of said arms.

In this way, the initial segment of each arm (6) can adopt any position within the web (1), from a position of maximum retraction to one of maximum extensions, as is the case with each segment of each arm (6–6') with respect to the other segments.

The various segments of each arm (6–6') are embodied as aluminium tubes, as mentioned above, preferably with a rectangular section, that are perfectly fitted to each other with the aid of Teflon or similar caps and that are also aided by bearings to facilitate their sliding.

Figure 3:
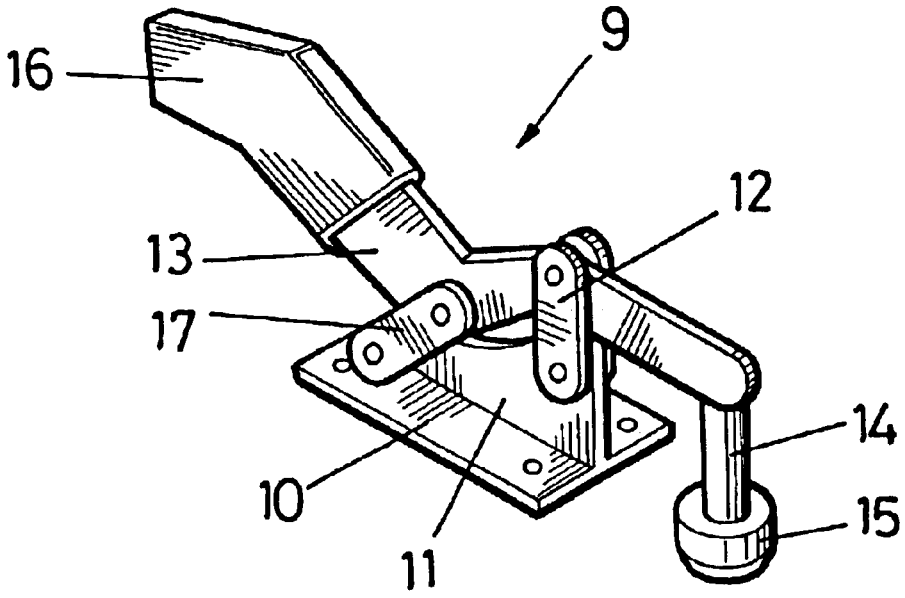
FIG. 3 shows a perspective enlargement of one of the attachments of the structure.

The various segments of each arm (6–6') can be locked in any of their operational positions by means of anchorings (9), as shown in FIG. 3, comprised of a baseplate (10) attachable to the same segment of the arm (6–6') from which rises vertically a bracket (11) to which it is jointed by means of a pair of connecting rods (12), an actuation lever (13) ending on one of its ends in a shaft (14) that in turn ends in a rubber plunger or the like (15), meant to rest on the adjacent segment of the arm (6–6') when the grip (16) of said lever (13) is suitably operated, with the locked position maintained in a stable manner with the aid of a swivelling cap (17).

Figure 4:
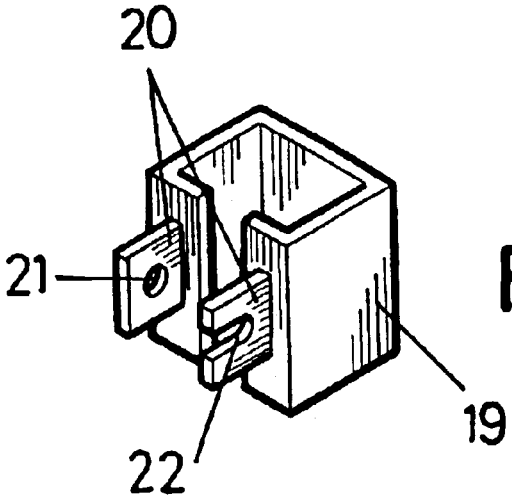
FIGS. 4 and 5 show corresponding perspective views of another two types of attachments that are used in said structure.

On the free end of the terminal segment of each arm (6–6'), and optionally on the intermediate segments and in all cases on the centre web (1), with the aid of a small auxiliary support (18), are attached the corresponding clips (19), as shown in detail in FIG. 4, consisting of an open tube that is referenced (19) whose opening is framed by two parallel brackets (20), on having an orifice (21) and the other a notch (22) on which acts a fast-action clamp (23) such that said clips act as clasps for the corresponding vertical tubes (24) that can thereby adjust their height with respect to the ground, and which incorporate on their lower end attachment means (25) for the corresponding sensors, that are duly connected to the control unit (5).

As can be inferred from the above description, the effective length of the arms (6–6') can be minimal, almost equivalent to that of one of its comprising segments, such as in an inoperative position of the automated levelling system, from which position it is possible to separate the sensors by any distance required by simply releasing the anchorings (9) and telescopically extending the segments of the arms (6–6') to the desired position of the tubes (24) which support said sensors, at which time the position of the sensors is locked by an operation in the opposite sense of the anchorings (9), which is also performed quickly and easily. Similarly, the height of the sensors can be adjusted by loosening the clips (23) and performing a vertical and telescoping displacement of the corresponding tubes (24).

Figure 5:
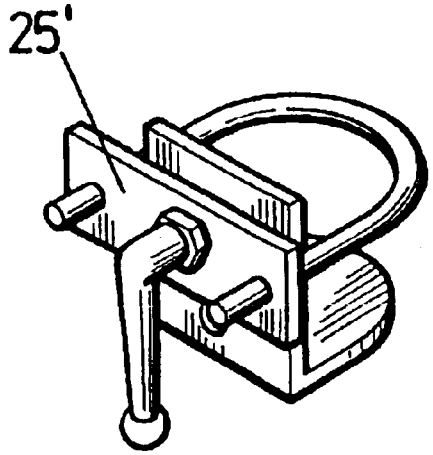

FIG. 5 shows an alternative embodiment (25') of the attachment means (25) of the sensors, although it should be obvious that the embodiment of the anchorings and attachments is simply shown by way of example and can be replaced by any other one deemed suitable without affecting the essence of the invention.

What is claimed is:

1. Structure for support and positional regulation of automated levelling systems, and for positional adjustment of various sensors used to detect ground irregularities that provide information to a control unit that determines an amount of asphalt to be supplied by a machine to which such structure is attached said structure comprising:

a centre web having means of attaching the structure to a machine, a pair of telescoping arms movable within said centre web and having segments which are embodied as corresponding tightly-fitting tubes, each arm provided with an end segment having a free end, a first clip provided on the free end of each end segment, a vertical tube attached to the first clip and provided on its lower end with a means for attachment of a first sensor to the vertical tube, and a second clip joined to the centre web attachment of a second sensor to the centre web.

2. Structure according to claim 1, wherein at least one other segment other than the end segments of the telescoping arms incorporates on its free end a further clip for attaching a further vertical tube for supporting a further sensor thereon.

3. Structure according to claim 1, wherein the centre web is a rectangular-prism shaped frame having a rear face to which is attached a strong tube inclined outwards and downwards that defines a bridge joining the centre web to the machine and is a means for lifting and distancing said centre web, the centre web further incorporating a control unit support for receiving a control unit that receives information from the sensors.

4. Structure according to claim 1, wherein the centre web defines two horizontal superposed housings for the telescoping arms and is further provided with bearings to aid in the sliding of the telescoping arms within the centre web.

5. Structure according to claim 1, wherein the segments of the telescoping arms are connected to each other by bearings and by Teflon (polytetrafluoroethylene) caps.

6. Structure according to claim 1, wherein each segment of each telescoping arm is stabilized with respect to an adjacent segment by a fast-action anchoring consisting of a lever that ends with an elastic plunger that acts on the adjacent segment.

* * * * *